US009476301B2

(12) United States Patent
Zenisek et al.

(10) Patent No.: US 9,476,301 B2
(45) Date of Patent: Oct. 25, 2016

(54) MINE VENTILATION DOOR WITH WINGS AND SLIDABLE OR POCKET PERSONNEL DOOR

(71) Applicant: American Mine Door Co., Cleveland, OH (US)

(72) Inventors: Daniel S. Zenisek, Medina, OH (US); Robert H. Chorman, Chardon, OH (US)

(73) Assignee: American Mine Door Co., Cleveland, OH (US)

( * ) Notice: Subject to any disclaimer, the term of this patent is extended or adjusted under 35 U.S.C. 154(b) by 918 days.

(21) Appl. No.: 13/774,515

(22) Filed: Feb. 22, 2013

(65) Prior Publication Data

US 2014/0024304 A1 Jan. 23, 2014

Related U.S. Application Data

(60) Provisional application No. 61/674,088, filed on Jul. 20, 2012, provisional application No. 61/674,007, filed on Jul. 20, 2012, provisional application No. 61/674,046, filed on Jul. 20, 2012.

(51) Int. Cl.

| | |
|---|---|
| ***E21F 1/14*** | (2006.01) |
| ***E21F 1/10*** | (2006.01) |
| ***E06B 1/52*** | (2006.01) |
| ***E05F 17/00*** | (2006.01) |
| ***E05F 15/63*** | (2015.01) |
| ***E06B 3/34*** | (2006.01) |
| ***E06B 5/12*** | (2006.01) |
| *E06B 3/36* | (2006.01) |
| *E05F 15/40* | (2015.01) |

(Continued)

(52) U.S. Cl.

CPC ..... *E21F 1/10* (2013.01); *E05F 15/63* (2015.01); *E05F 17/004* (2013.01); *E06B 1/52* (2013.01); *E06B 3/34* (2013.01); *E06B 5/12* (2013.01); *E05F 15/40* (2015.01); *E05F 15/73* (2015.01); *E05F 15/79* (2015.01); *E05F 2015/763* (2015.01); *E05F 2017/008* (2013.01); *E05Y 2201/62* (2013.01); *E05Y 2800/11* (2013.01); *E05Y 2900/11* (2013.01); *E05Y 2900/40* (2013.01); *E06B 3/362* (2013.01)

(58) Field of Classification Search

CPC ..... E21F 1/10; E05F 15/63; E05F 17/004; E06B 1/52; E06B 3/34; E06B 5/12

USPC ..... 454/169, 195

See application file for complete search history.

(56) References Cited

U.S. PATENT DOCUMENTS 1,432,972 A * 10/1922 Dealy ..... E21F 1/10 246/309

RE34,053 E * 9/1992 Kennedy ..... E21F 1/10 405/132

(Continued)

*Primary Examiner* — Steven B McAllister

*Assistant Examiner* — Jonathan Cotov

(74) *Attorney, Agent, or Firm* — Richard M. Klein; Fay Sharpe LLP

(57) ABSTRACT

A personnel access door assembly of an opposing wing of a mine ventilation door. The personnel access door includes a frame including a top portion, a bottom portion, a first post portion and a second post portion, the top frame portion and the bottom frame portion coupled to respective top and bottom ends of the first post and second post portions. The personnel access door further includes sets of trolley wheels affixed to the top or bottom of the frame to engage a top rail or bottom rail affixed on the opposing wing.

22 Claims, 12 Drawing Sheets

(51) Int. Cl.
*E05F 15/73* (2015.01)
*E05F 15/79* (2015.01)

(56) References Cited

U.S. PATENT DOCUMENTS 5,240,349 A * 8/1993 Kennedy ..... E05F 5/12 405/132
RE36,853 E * 9/2000 Kennedy ..... E21F 1/10 405/132
6,361,430 B2 * 3/2002 Kitching ..... 454/169
6,425,820 B1 * 7/2002 Kennedy ..... E21F 1/10 405/144
6,938,372 B2 * 9/2005 Kennedy ..... E05F 15/53 16/49
6,955,594 B2 * 10/2005 Kennedy ..... E21F 1/12 405/144
9,181,802 B2 * 11/2015 Zenisek ..... E21F 1/10
2004/0083653 A1 * 5/2004 Delgado ..... E05D 15/0652 49/120
2014/0299280 A1 * 10/2014 Bowman ..... E05F 17/004 160/199

* cited by examiner

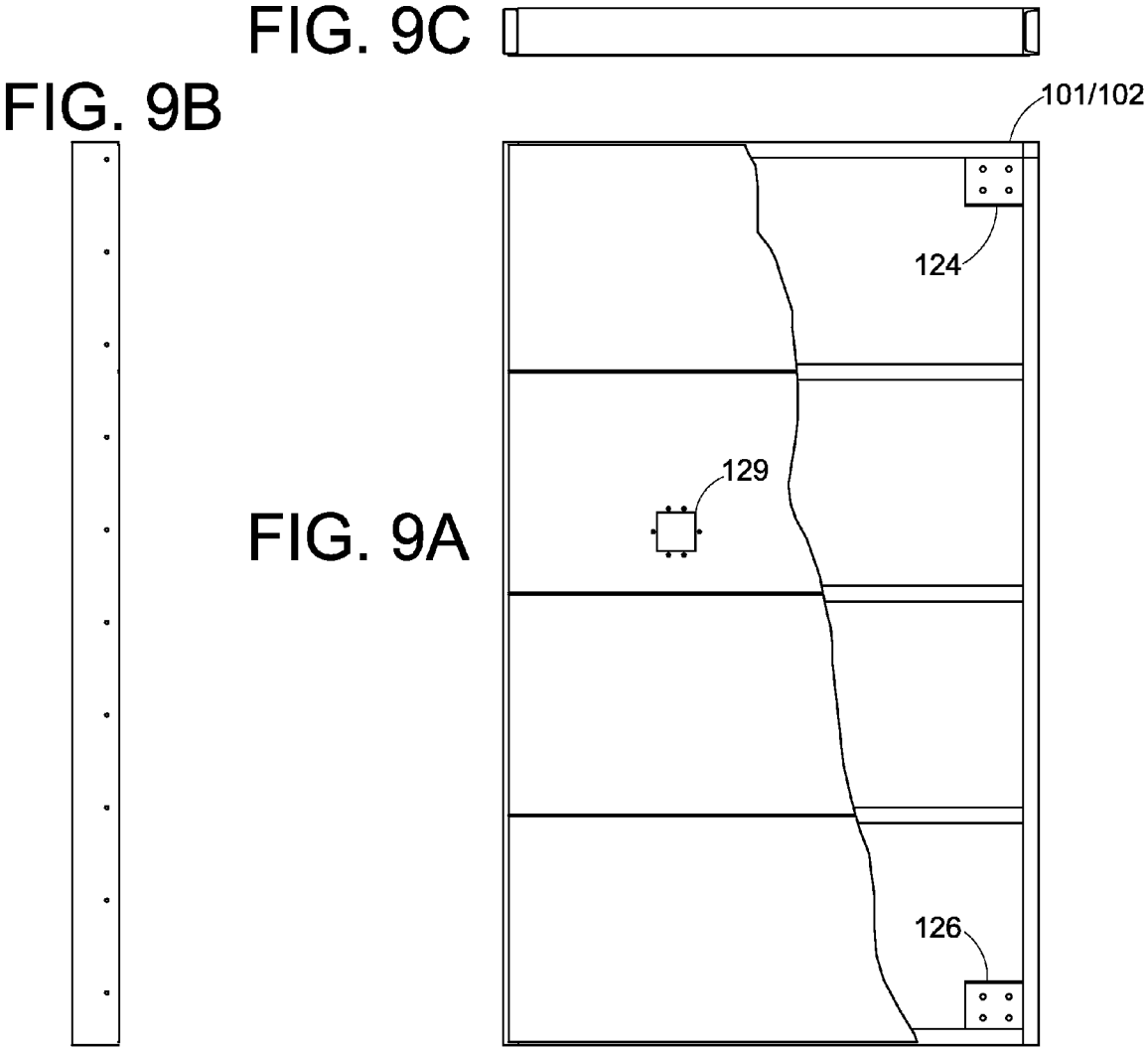
FIG. 9A
FIG. 9B
FIG. 9C
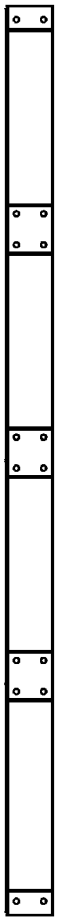
FIG. 9D

MINE VENTILATION DOOR WITH WINGS AND SLIDABLE OR POCKET PERSONNEL DOOR

CROSS-REFERENCE TO RELATED APPLICATIONS

This application claims priority to U.S. Provisional Application Ser. No. 61/674,046, filed Jul. 20, 2012 and entitled CONTROL SYSTEM FOR MINE VENTILATION DOOR, U.S. Provisional Application Ser. No. 61/674,007, filed Jul. 20, 2012 and entitled ROBUST MINE VENTILATION DOOR WITH SINGLE ACTUATION SYSTEM, and U.S. Provisional Application Ser. No. 61/674,088, filed Jul. 20, 2012 and entitled MINE VENTILATION DOOR WITH WINGS AND SLIDABLE OR POCKET PERSONNEL DOOR, the entirety of which are incorporated by reference herein.

BACKGROUND

The present disclosure is directed to mine doors and more particularly, an access door for personnel through ventilation mine doors.

Prior to the introduction of automated mine doors, mine operators used "snappers" to open and close doors on the haulage road, so that the motorman would not have to stop. The snapper would open the door, wait for the last car to pass, close the door and then run to get back on the train/tram for the remainder of the trip. In practice, however, often times the motorman would not stop, he would only slow down so that snapper could run ahead of the locomotive and open door. This practice proved unsafe for the miners, the motorman, and detrimental to both the locomotive and the doors.

The advent of machine-assisted mine doors helped alleviate some of the dangers; however such doors still required manual engagement of the machines to open and close the doors. Furthermore, the pressures being exerted on these doors also increased, as ventilation became more effective and powerful due to increases in operating temperatures, depths, mine size, etc. As mines reach greater depths, the size of the doors must increase to accommodate larger and larger equipment, i.e., the easily accessible minerals have already been retrieved, leaving the harder to access deposits farther underground. The increase in size has led accordingly to increases in the power, both applied and consumed, in opening and closing these doors.

The typical mine door includes two wings, which either swing inward or outward, depending upon the configuration. The strength, size, and functional machinery for proper function substantially increase in high-pressure environments. Thus, when either opening or closing, the pressure provides assistance. However, this standard design is hindered in the reverse operation, wherein not only the mass of the doors must be moved, but also the opposing flow of air must be overcome to properly close the mine doors. As will be appreciated, such standard design is notably hindered in speed of operation as a result of the wings of the door both swinging either inward or outward, as well as negatively impacted by the air pressure, which only helps either open or close and hindering the opposite.

Modern mine doors may be tasked with operating under constant pressures including 400,000 inch/Lb./torque, 800,000 inch/Lb./torque, and 1,200,000 inch/Lb./torque. As stated above, in most existing mines, the more readily accessible minerals have generally been mined out, requiring the exploitation of veins located deeper underground. In parallel with this depth increase is an increase in the types of vehicles and equipment employed in the mines, as well as an increase in the speed of mining operations that advances in the mining arts have wrought. This increased speed of operations requires that mine doors be capable of operating a large number of cycles each day, e.g., 300 cycles per day, 365 days a year. Due to these demanding conditions, the moving components of a mine door are under increased strain and wear.

Attempts to alleviate some of these issues in high-pressure environments include each wing of the door swinging in an opposite direction. This allows for the high-pressure to facilitate opening and closing of the door, thereby assisting the machinery in the process. A further benefit of such a design includes the coupling of both the top and bottoms of each wing together via respective connecting bars, thus synchronizing the opening/closing of the wings. The power for such wing generally includes at least two pistons or other means of opening or closing the wings. Such embodiments still require an unreasonable amount of time to fully open or close, and may include connecting bars that are frequently damaged by equipment transiting the doorway, e.g., either running over the lower connecting bar or impacting the upper or top connecting bar. These types of mine door embodiments require frequent maintenance and repair due to the damage from machinery and the number of operating components.

These large doors may exceed twenty feet in height and twenty-five feet in width, requiring large amounts of effort to open or close simply by virtue of the mass of the door involved. Having to open and close these doors for each miner accessing the shaft places increased wear on the components of the doors, consumes power, and allows substantial air through, negating the benefits inherent in ventilation doors. The pressure exerted on the door may further impact operations, particularly when power is lost during emergencies. Without power, these large doors become severe obstacles to miners trying to evacuate the mine. Furthermore, in the event of partial cave-ins, one or both wings may be blocked, preventing either or both wings from swinging open, thereby trapping the miners or other personnel.

Personnel access doors within ventilation doors currently are hinged affairs, requiring a ninety-degree pivot in order to open. Miners are forced to contend with not only air pressure in opening and closing the door, but also the same concerns as presented above with respect to cave-ins preventing the pivoting. For example, when transiting such a door, the miner may have to use an inordinate amount of effort to open the door into the wind, but upon release the door slams shut, potentially causing damage to the door or injury to the miner.

Accordingly, what is needed is a personnel access door within an automated, high-pressure mine door to provide economical, safe, efficient, and easy access to personnel through ventilation mine doors, means of escape in times of emergency, and the like. Preferably, such access door should be capable of incorporation into ventilation control doors for all types of track and trackless mines, including, e.g., coal, uranium, salt, gypsum, clay, gold, potash, titanium, copper, molybdenum, platinum, etc.

BRIEF DESCRIPTION

One aspect of the present disclosure discussed herein is drawn to a personnel access door assembly of at least one opposing wing of an associated mine ventilation door. The personnel access door includes a frame having a top portion, a bottom portion, a first post portion and a second post portion. The top frame portion and the bottom frame portion are coupled to the respective top and bottom ends of the first post and second post portions. The personnel access door also includes at least one set of trolley wheels affixed to the top portion of the frame. The personnel door assembly includes a top rail affixed to the at least one opposing wing, the top rail parallel to a top and bottom of the at least one opposing wing, the top rail configured to slideably engage the at least one set of trolley wheels. The assembly also includes a bottom rail affixed parallel to the bottom of the at least one opposing wing, the bottom rail and the top rail configured to slideably receive the respective top and bottom portions of the frame.

Included in further embodiments the personnel access door includes a set of parallel crossbeams coupled to the first and second posts of the frame, with the crossbeams being positioned equidistant from each other and the top and bottom frame portions.

In other embodiments, the personnel access door includes a skin covering the frame portions, the skin configured of a suitable gauge metal.

In still other embodiments, the bottom rail includes a plurality of separate guides configured to hold the personnel access door to the wing of the associated mine ventilation door.

In particular embodiments, the personnel access door assembly also includes at least one sensor affixed to the wing in proximity to the personnel access door, the sensor configured to sense at least one of an opening and a closing of the personnel access door.

In further embodiments, the personnel access door assembly includes a handle affixed to the personnel access door, the handle capable of being recessed into the personnel access door.

In another aspect, a mine ventilation door includes two opposing wings. At least one opposing wing includes an opening extending from a first side of the opposing wing to a second side of the at least one opposing wing. The opposing wing further includes a top rail parallel to a top and a bottom of the at least one opposing wing, a bottom rail parallel to the top rail, and a personnel access door. The personnel access door includes a frame including a top portion, a bottom portion, a first post portion and a second post portion, the top frame portion and the bottom frame portion coupled to respective top and bottom ends of the first post and second post portions. The personnel access door also includes a skin covering the frame portions, and at least one set of rollers affixed to at least one of the top portion and bottom portion of the frame configured to slideably engage at least one of the top and bottom rails.

Included in further embodiments, the personnel access door comprises a set of parallel crossbeams coupled to the first and second posts of the frame, the crossbeams positioned equidistant from each other and the top and bottom frame portions. The personnel access door may also include a skin covering the frame portions.

In other embodiments, the top rail and the bottom rail are located within the at least one opposing wing, such that the personnel access door is configured to slide into the at least one opposing wing along the top rail and the bottom rail.

In further embodiments, the top rail and the bottom rail are externally located on the first side or the second side of the at least one opposing wing, such that the personnel access door is configured to slide along the externally located top rail and the bottom rail.

These and other non-limiting aspects and/or objects of the disclosure are more particularly described below.

BRIEF DESCRIPTION OF THE DRAWINGS

The following is a brief description of the drawings, which are presented for the purposes of illustrating exemplary embodiments disclosed herein and not for the purposes of limiting the same.

FIG. 9A illustrates a detailed front view of a wing panel assembly for a major wing or minor wing for use in the high-pressure door assembly depicted in FIGS. 1A-4 opposite the wing panel having the personnel access door.

FIG. 9B illustrates a detailed first side view of a wing panel assembly for a major wing or minor wing for use in the high-pressure door assembly depicted in FIGS. 1A-4 opposite the wing panel having the personnel access door.

FIG. 9C illustrates a top detailed view of a wing panel assembly for a major wing or minor wing for use in the high-pressure door assembly depicted in FIGS. 1A-4 opposite the wing panel having the personnel access door.

FIG. 9D illustrates a detailed second side view of a wing panel assembly for a major wing or minor wing for use in the high-pressure door assembly depicted in FIGS. 1A-4 opposite the wing panel having the personnel access door.

DESCRIPTION

Figures 1A, 1B, 1C, 1D:
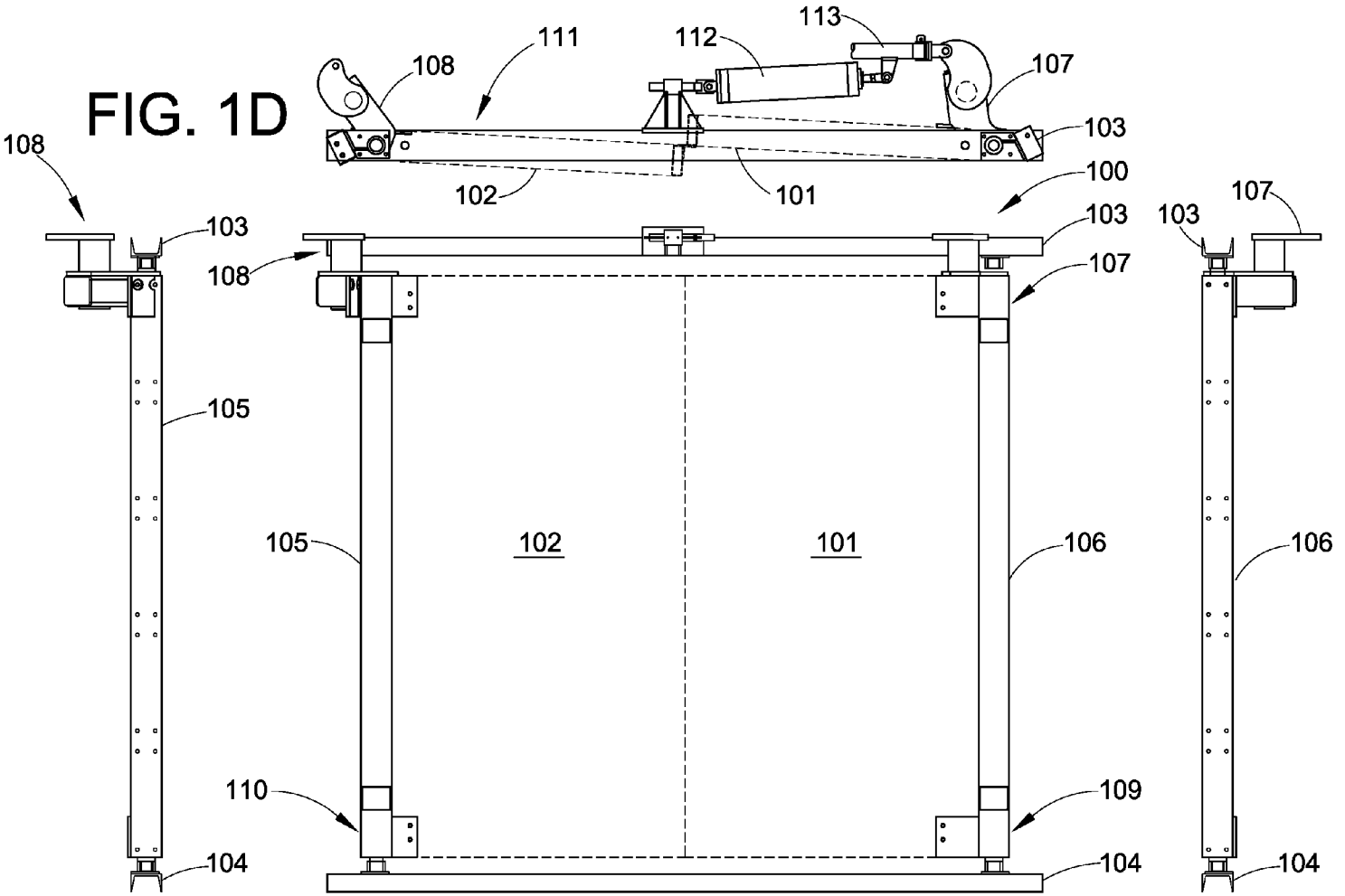
FIG. 1A illustrates a front view of a schematic representation of a high-pressure door assembly in accordance with one embodiment of the present disclosure.
FIG. 1B illustrates a side view of the minor wing of the schematic representation of a high-pressure door assembly in accordance with one embodiment of the present disclosure.
FIG. 1C illustrates a side view of the major wing of the schematic representation of a high-pressure door assembly in accordance with one embodiment of the present disclosure.
FIG. 1D illustrates a top view of the schematic representation of a high-pressure door assembly in accordance with one embodiment of the present disclosure.
Figure 1E:
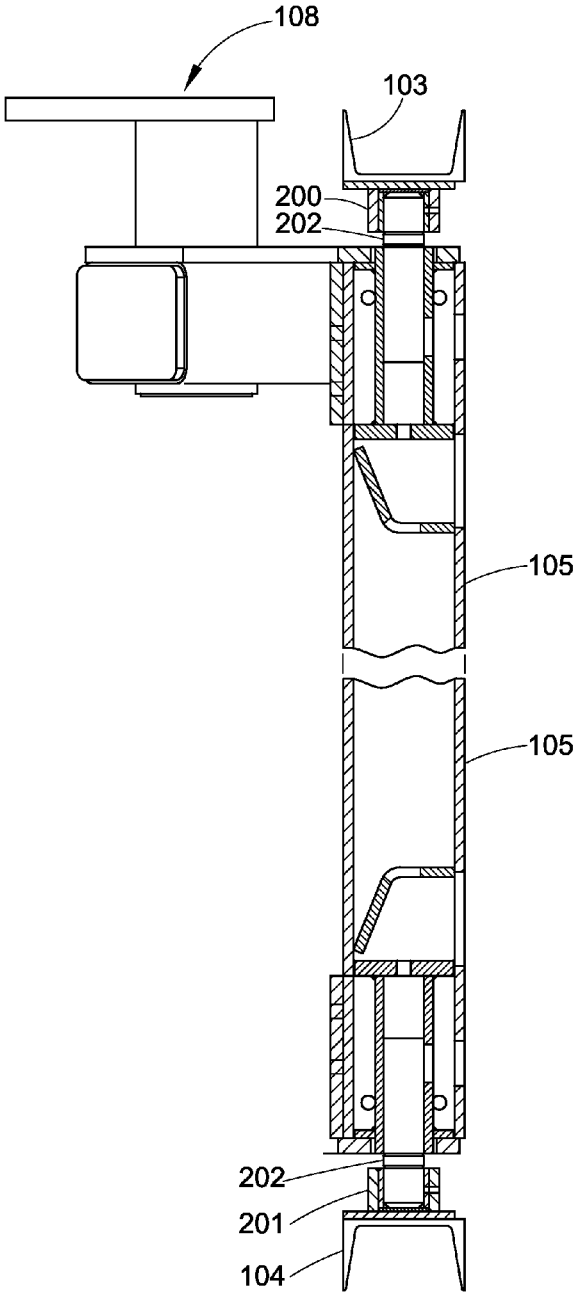
FIG. 1E illustrates a first side view of top and bottom portions of the minor wing hub and bearing for a high-pressure door assembly in accordance with one embodiment of the present disclosure.
Figure 1F:
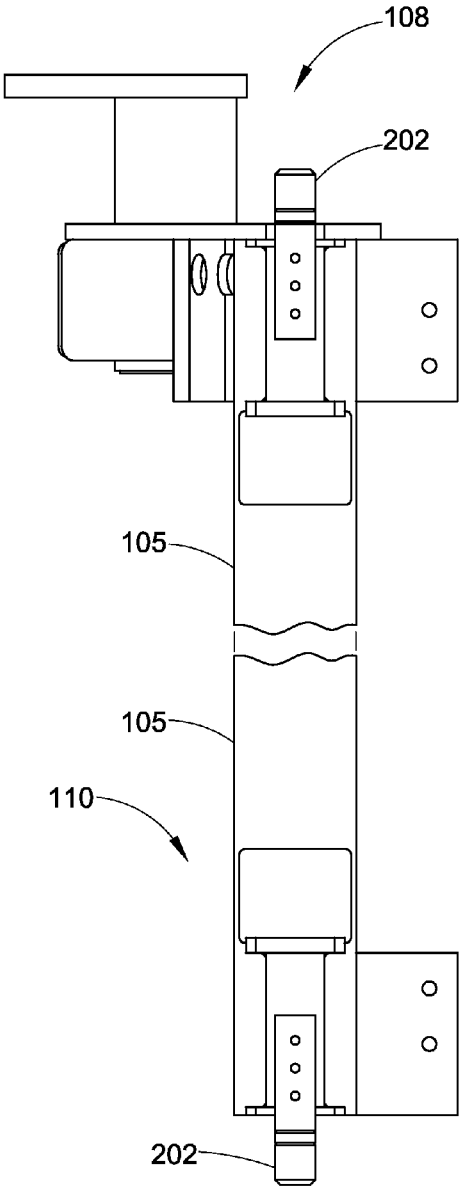
FIG. 1F illustrates a second side view of top and bottom portions of the minor wing hub and bearing for a high-pressure door assembly in accordance with one embodiment of the present disclosure.
Figure 1G:
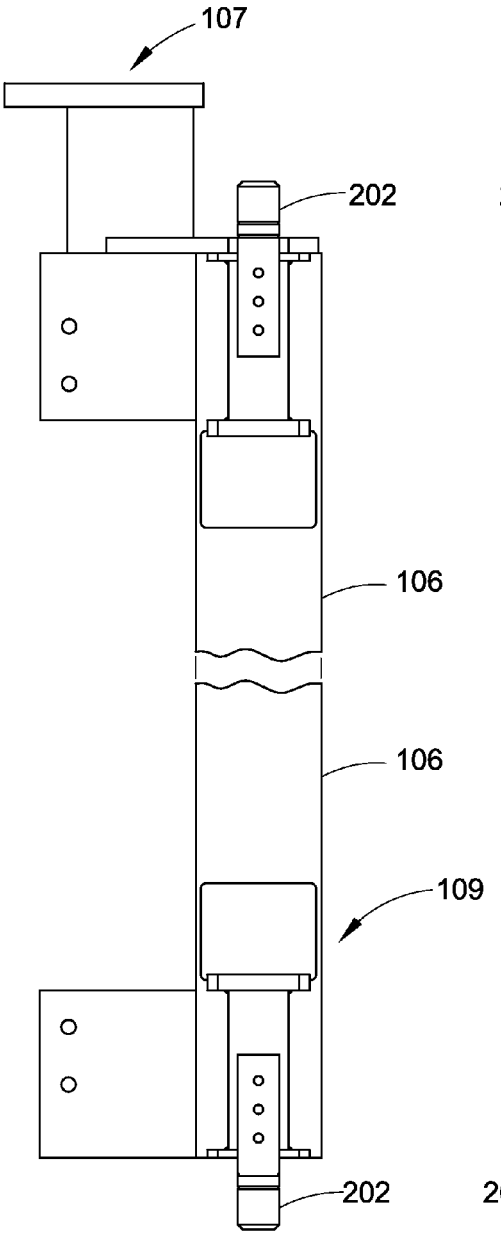
FIG. 1G illustrates a first side view of top and bottom portions of the major wing hub and bearing for a high-pressure door assembly in accordance with one embodiment of the present disclosure.
Figure 1H:
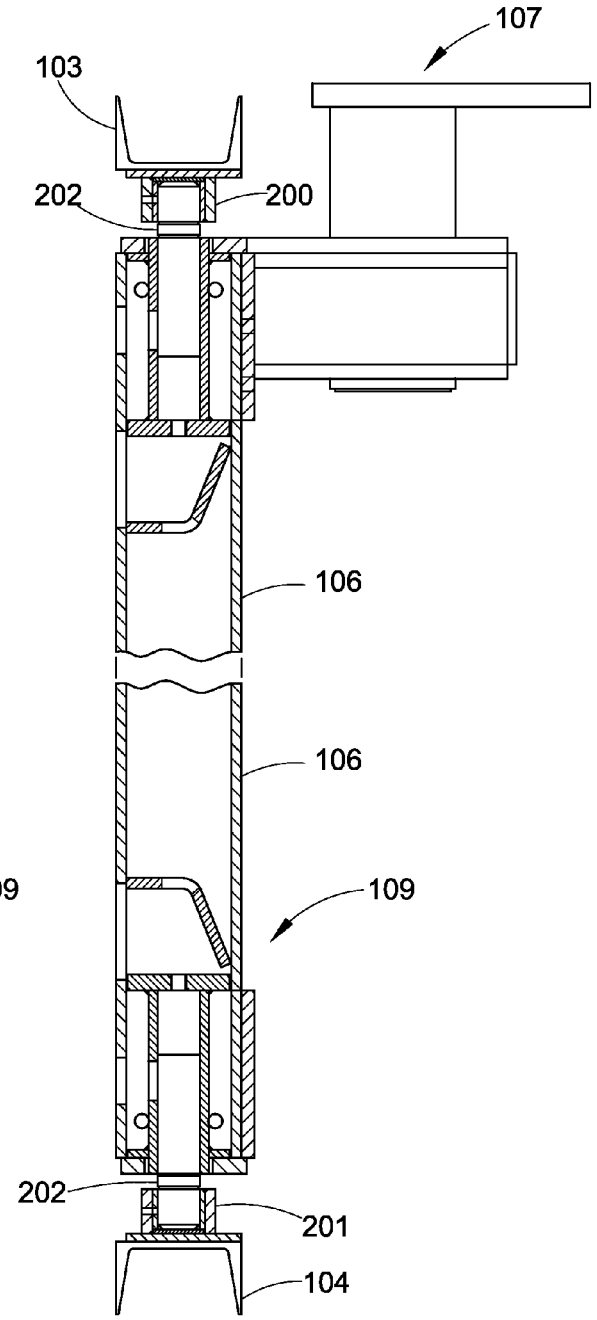
FIG. 1H illustrates a second side view of top and bottom portions of the minor wing hub and bearing for a high-pressure door assembly in accordance with one embodiment of the present disclosure.

One or more implementations of the subject application will now be described with reference to the attached drawings, wherein like reference numerals are used to refer to like elements throughout.

Turning now to FIGS. 1A-4, there are shown several illustrations of the various components of a high-pressure mine door assembly and installation in accordance with one embodiment of the present disclosure. FIG. 1A depicts a front view of the mine door assembly 100 including a major wing 101, a minor wing 102, and frame components cap 103, sill 104, a first post 105 (shown in FIG. 1B) and a second post 106 (shown in FIG. 1C).

Also illustrated in FIGS. 1A-1C are the major hub 107, the minor hub 108, major sill bearing assembly 109, and the minor sill bearing assembly 110. As illustrated in FIGS. 1A-1H, the cap 103 includes bearings 200 operative to receive pins 202 extending upward from the wings 101-102 so as to enable the rotation of the wings 101-102 with respect to the stationary cap 103 (shown in FIG. 1D). Similarly, the sill 104 includes bearings 201 (i.e., portions of the sill bearing assemblies 109-110) operative to receive pins 202 extending downward from the wings 101-102 so as to enable the rotation of the wings 101-102 with respect to the stationary sill 104. In some embodiments, hardened pins 202 and bronze or other durable materials may be used in the bearings 200-201.

The wings 101-102 may further include seals, gaskets, or the like, to prevent airflow from circumventing the door assembly 100. Expanded views of these components are also illustrated in FIGS. 1E-1H as shown. A top view 111 is presented in FIG. 1D illustrating the connection of a drive mechanism 112 to the cap 103 and the major hub 107 and minor hub 108, the major and minor wings 101-102 being connected via the connecting bar 113 that is engaged by the drive mechanism 112 to open and close the wings 101-102. As illustrated in the subsequent figures, the connecting bar 113 is moveably coupled to the major hub 107 and the minor hub 108. The drive mechanism 112 may be any suitable mechanism for opening and closing the wings 101-102 including, for example, hydraulic, pneumatic, manual, electronic, or the like. The drive mechanism 112 may include cushions so as to allow for faster cycling of the door assembly 100, e.g., located at opposing ends of an hydraulic or pneumatic driven cylindrical actuator. When implemented, the cushion effect provided by such cushions may affect a portion of the stroke of the cylindrical actuator, e.g., 2 inches, 4 inches, or the like, depending on the length of the stroke, the size of the door, etc. It will be appreciated that such cushions may be adjustable and may be manipulated to achieve certain rates of cushioning, dependent upon the individual needs of the mine in which the doors are implemented. Accordingly, such cushions may increase door speed travel and prevent damage to the door assembly 100.

As depicted in FIG. 1D, a single drive mechanism 112 is advantageously used, one end coupled to the cap frame portion 103 and the drive portion coupled to the connecting bar 113. Upon engagement of the drive mechanism 112, the drive portion forces the connecting bar 113 to move, thereby opening the wings 101-102 of the door assembly 100. It will be appreciated that the configuration of the hubs 107 and 108, as illustrated by the feet thereof (discussed below) facilitate the fast opening and closing of the wings. Furthermore, placement of the drive mechanism 112 and connecting bar 113 parallel with or slightly above the bottom of the cap frame portion 103 prevents damage to the mechanism 112 and bar 113 by equipment transiting through the door assembly 100. The drive mechanism 112 may also be located midway between the cap frame portion 103 and the sill frame portion 104, with the corresponding connecting bar 113 operatively coupled at the cap portion 103 or frame portion 104 and the drive mechanism 112 to one of the major or minor wings 101-102.

Figure 2A:
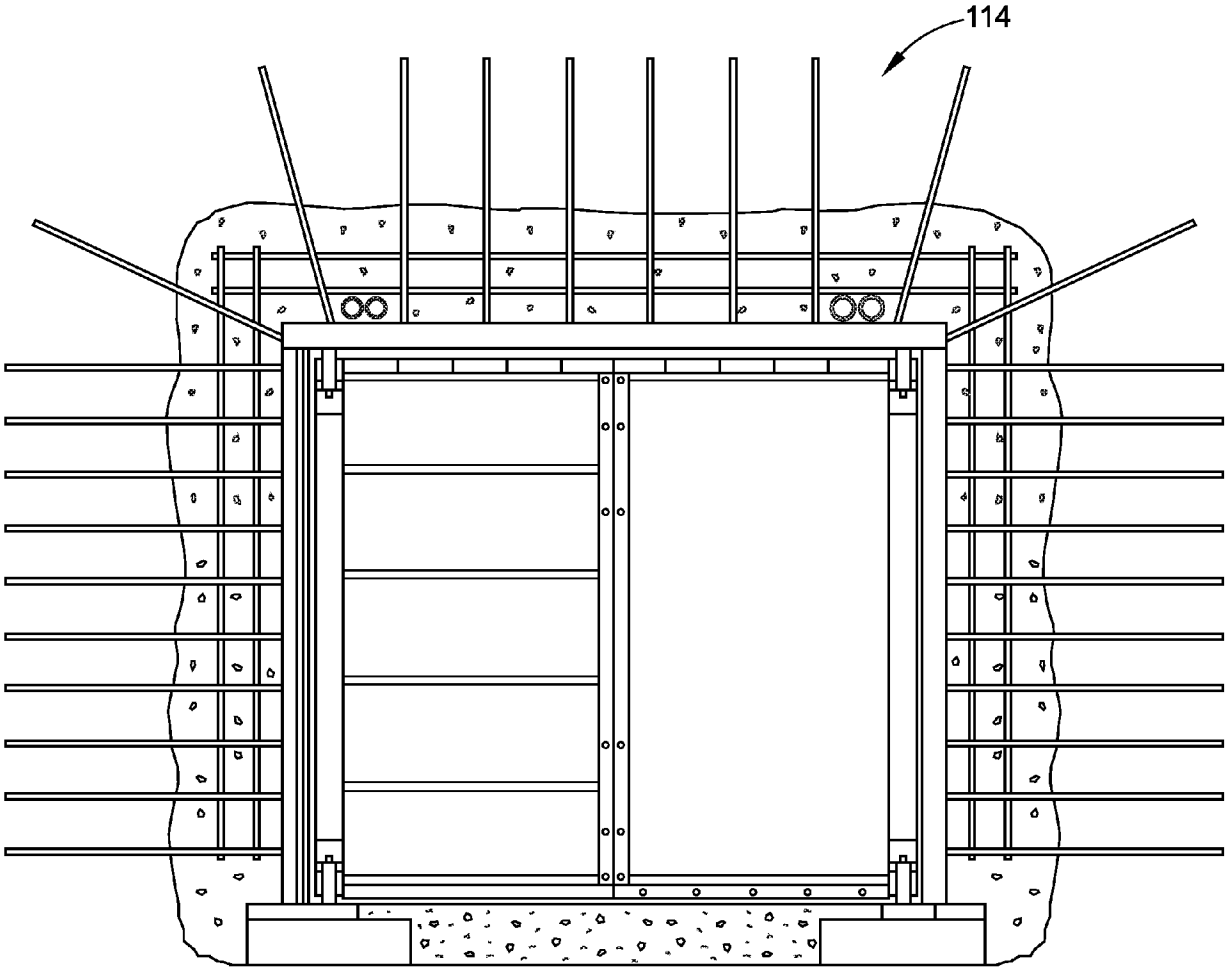
FIG. 2A illustrates a schematic representation of a high-pressure door assembly installation in accordance with one embodiment of the present disclosure.
Figure 2C:
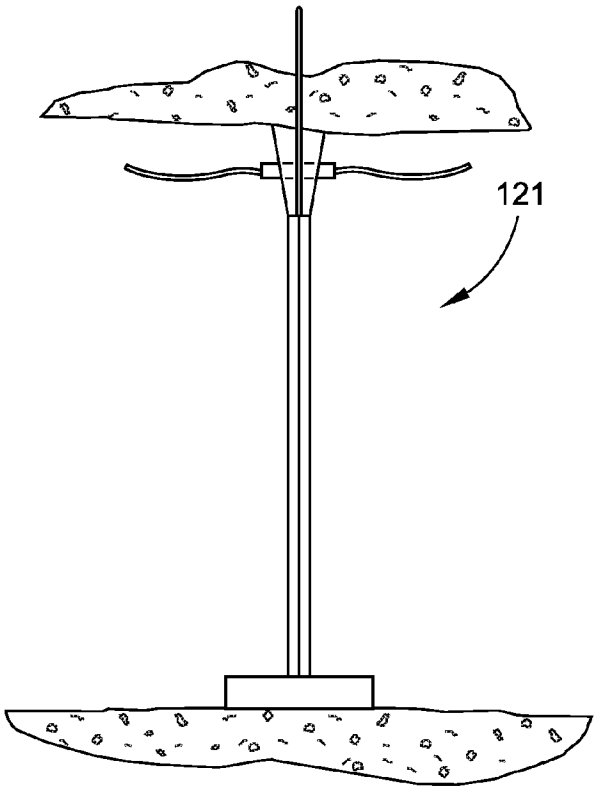
FIG. 2C illustrates a cross-sectional view of the schematic representation of a high-pressure door assembly installation in accordance with one embodiment of the present disclosure.
Figure 2B:
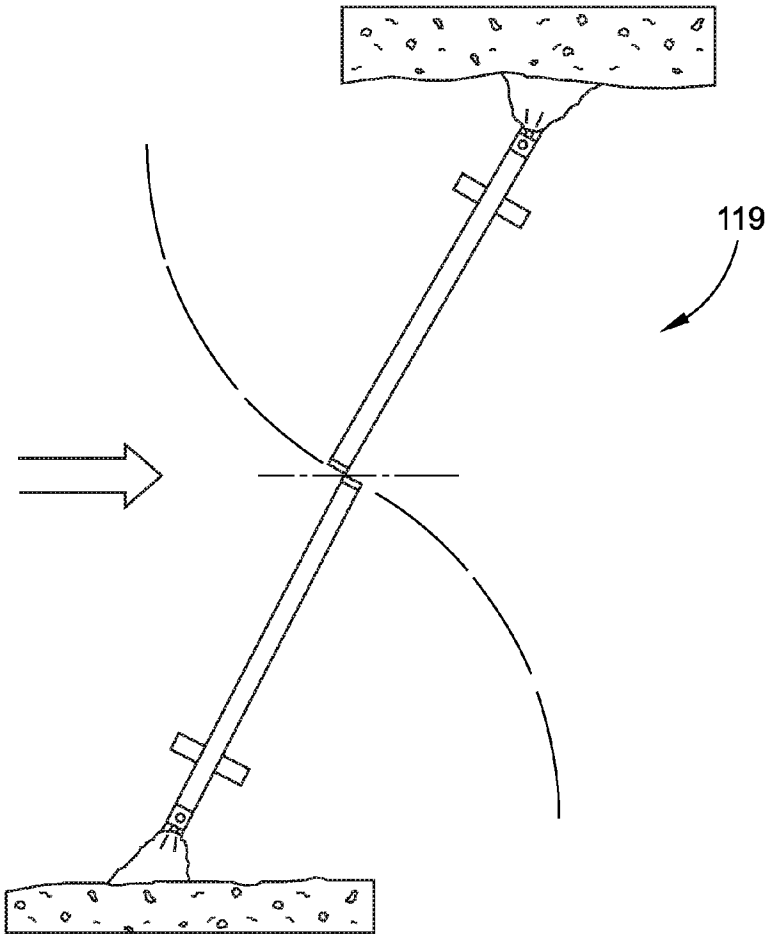
FIG. 2B illustrates a top view of the schematic representation of a high-pressure door assembly installation in accordance with one embodiment of the present disclosure.

FIGS. 2A-2C illustrate an installation 114 of the mine door assembly 100. FIG. 2A depicts a front view of the installation 114, illustrating the securing of the cap 103, sill 104, and sides of the mine door assembly 100 to the surrounding ventilation/mine shaft. FIG. 2B is a side view 119 of the installation 114 shown in FIG. 2A depicting the slanted orientation of the assembly 100 to facilitate faster opening of the wings 101-102. FIG. 2C illustrates a cross-sectional view 121 of the installation 114, 119 of the mine door assembly 100 shown in FIGS. 2A-2B. As previously discussed, the speed with which a mine door cycles open and closes has an impact on the overall operation of the mine, i.e., the speed with which equipment, personnel or ore may transit a mine shaft. Current implementations of mine doors may require 45-50 seconds to cycle open, with a corresponding time to cycle close. In contrast, the subject embodiments employ a cantilevered or offset implementation, wherein the wings 101-102 of the mine door 100 open from 9 to 16 seconds, in accordance with the size of the door. To achieve such speed, the wings 101-102 are positioned at a 12/6 pitch orientation, thereby reducing the distance required to open and close the wings 101-102. That is, each wing 101 and 102 need swing open two-thirds to allow full access to the shaft. In one particular embodiment, each wing 101 and 102 swings open approximately 63° to allow full access to the shaft.

Pairs of such high-pressure door assemblies 100 may be emplaced in a mine shaft so as to facilitate the formation of an airlock there between. Such an airlock may be used to prevent outgassing or in gassing to unused portions of a mine, to prevent dust accumulation in non-working sites, to send air to the face of the mine (where current mining is occurring), to control the amount of airflow through the shaft, or the like. For example, a mine operator may want to restrict the flow of air to a certain portion of the mine, but may still need to get equipment through. In order to facilitate this traffic, the airlock is formed of a set of two or more door assemblies. One door will open while the other remains closed. Once the traffic has transited the open door, that door will close following which the next door opens. Previous mine doors made this a long and arduous process. In contrast, the orientation and design of the subject high-pressure mine door assembly 100 facilitates faster opening and closing, while also making such opening easier to accomplish due to the opposing wing design, i.e., one door wing comes forward and the other door wing goes backwards in synchronization via the connecting bar 113.

Figure 3:
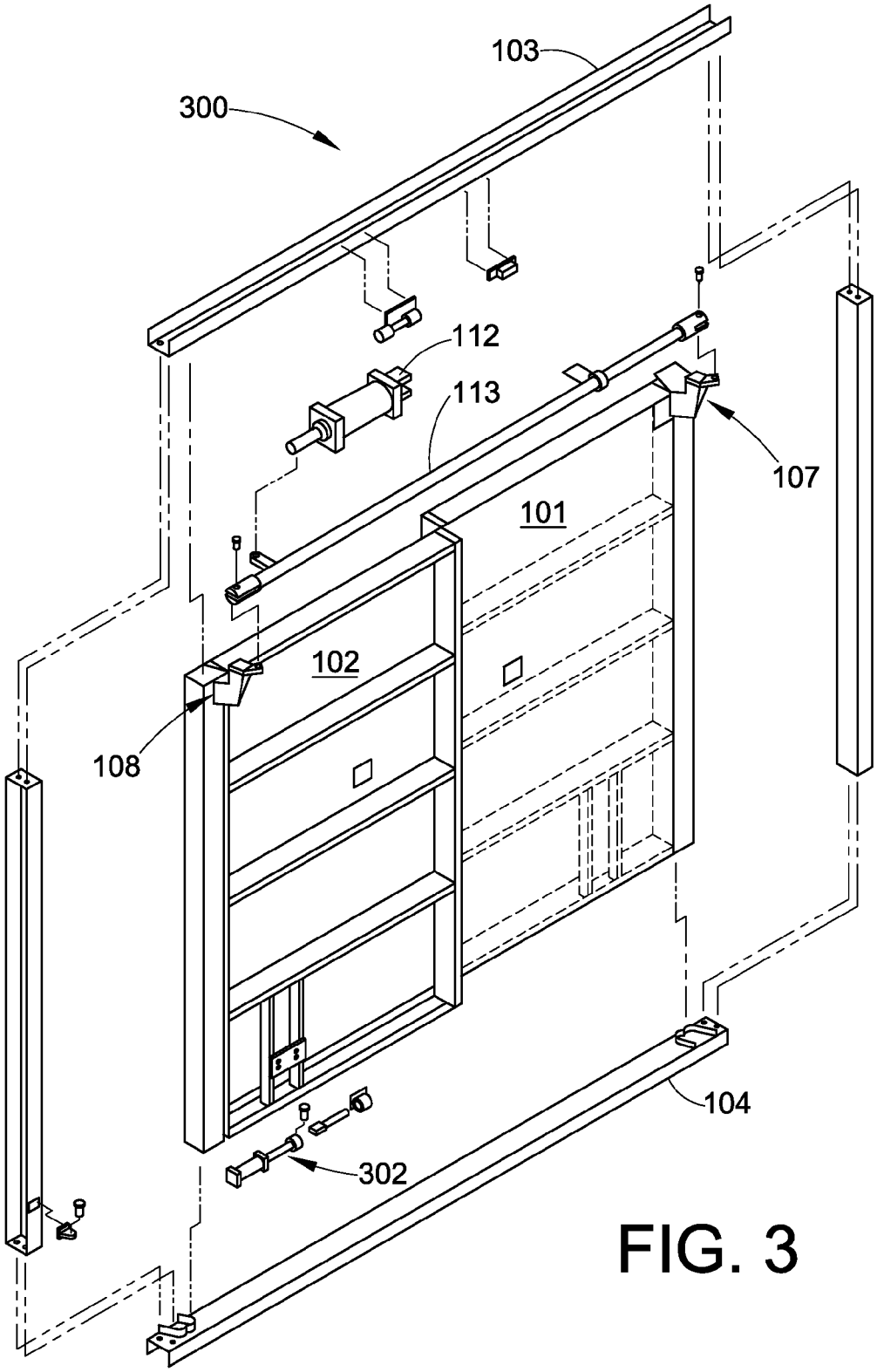
FIG. 3 illustrates an alternate high-pressure mine door assembly in accordance with one embodiment of the present disclosure.
Figure 4:
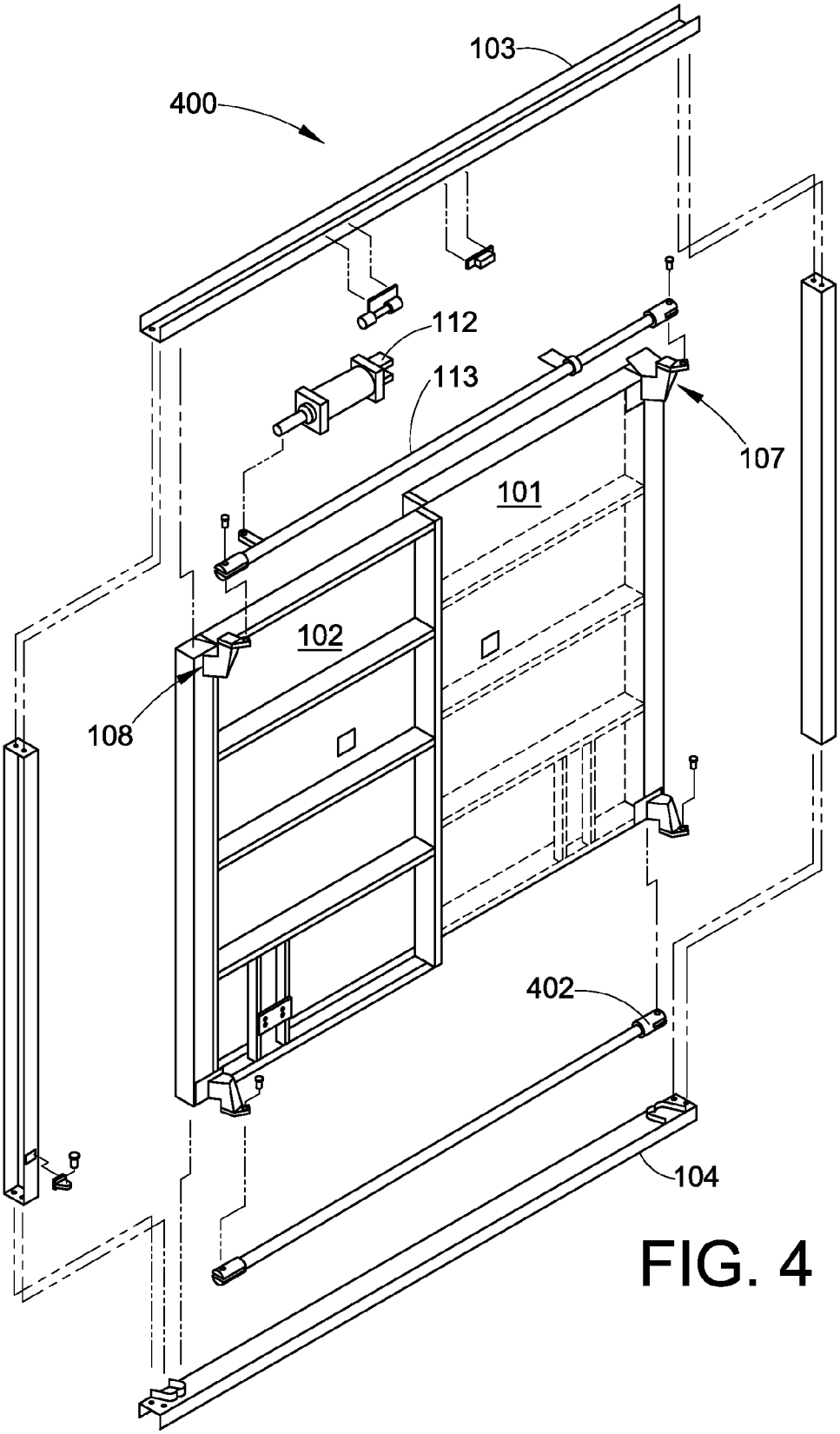
FIG. 4 illustrates another alternate high-pressure mine door assembly in accordance with one embodiment of the present disclosure.

FIGS. 3-4 illustrate alternate implementations of mine door assemblies 300 and 400 at the suitable 12-6 orientation. As shown in FIG. 3, the mine door assembly 300 includes a supplemental drive 302 coupled to the lower portion of the minor wing 102. The mine door assembly 400 of FIG. 4 includes a secondary connecting bar 402, coupling the bottom portions of the minor wing 102 and the major wing 101. Although not shown in FIGS. 3 and 4, either wing 101 or 102 may include a personnel access door as illustrated in FIGS. 5A-9D, discussed in greater detail below.

As illustrated in FIGS. 1A-2C, the high-pressure mine door assembly 100 includes major wing 101 and a minor wing 102, with the wings 101-102 coupled together by a top-mounted connecting bar 113 located at least parallel to or slightly above the cap frame portion 103 to which the wings 101-102 are rotatably coupled via the hubs 107-108. Each wing 101-102 is further coupled to the sill frame portion 104 via sill hubs 109-110. As illustrated, each wing 101-102 swings in opposing directions and is driven to open or close via at least one drive mechanism 112 operative on the connecting bar 113. As illustrated in greater detail below with respect to FIGS. 5A-9D, each hub assembly 107-108 includes a pivot point located above the wing and extending perpendicularly from the top frame portion. In one embodiment, the pivot bearings use bronze bushings and hardened pins, which lend strength and durability to the mine doors of the present disclosure.

Figure 5B:
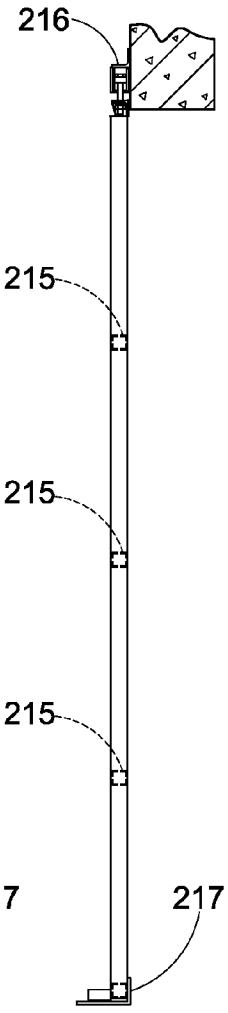
FIG. 5B illustrates a detailed representation of the personnel access door incorporated into a wing of the high-pressure door assembly depicted in FIGS. 1A-4.
Figure 5A:
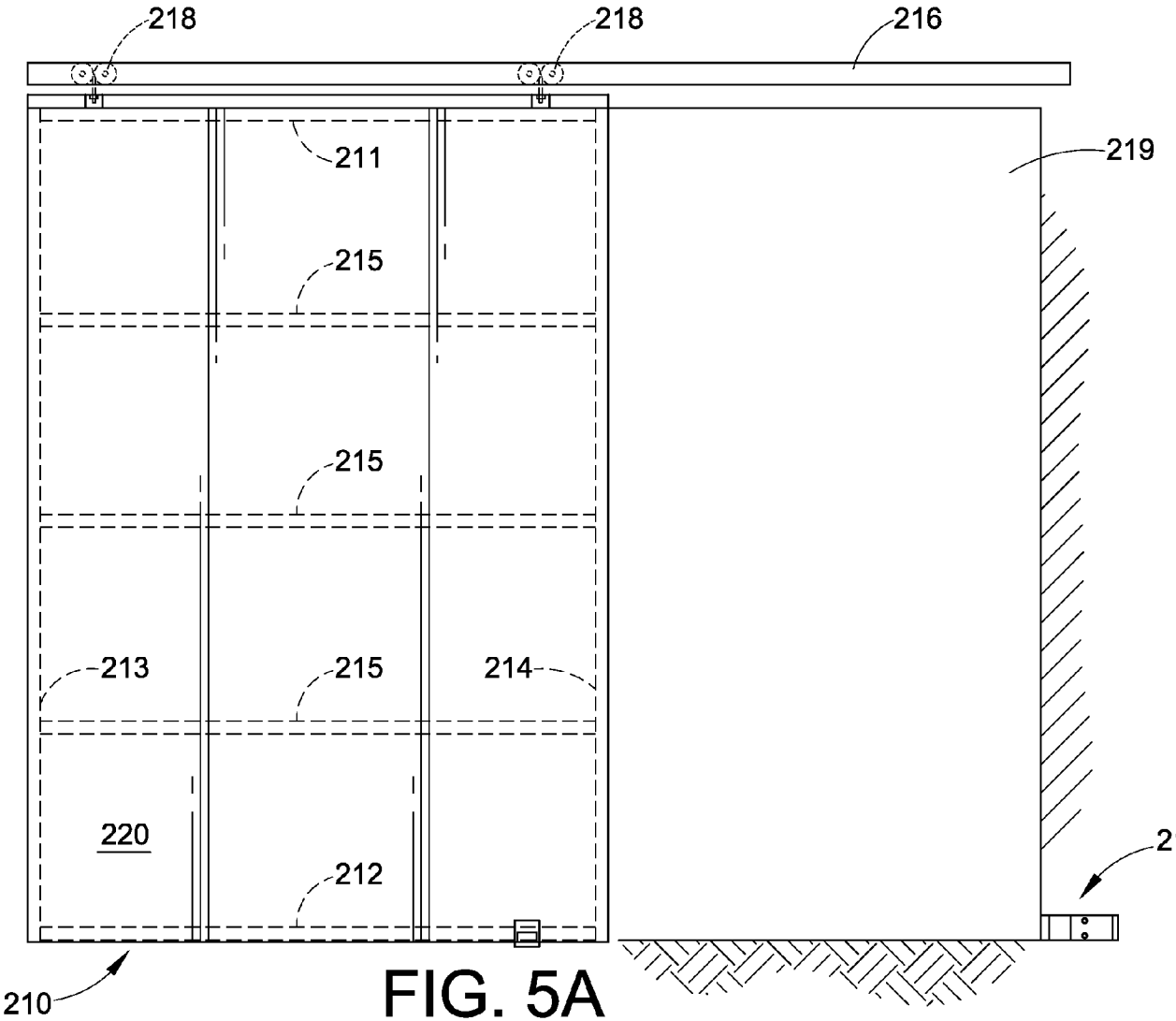
FIG. 5A illustrates a detailed representation of the personnel access door incorporated into a wing of the high-pressure door assembly depicted in FIGS. 1A-4.

FIGS. 5A-5B respectively depict a front and side view of the personnel access door 210 in the wing 101 or 102 of the mine door assembly 100 in accordance with one embodiment of the present disclosure. The personnel access door 210 may be a sliding or pocket type door, as illustrated in FIGS. 5A-9D. In other embodiments contemplated herein, the personnel access door may be a concave rotating door located within one wing, the concave door rotating around top and bottom pivots, so as to allow a minor, rescuer, etc., the ability to transit through one of the wings 101 or 102 without requiring the mine door assembly 100 to open. For example, the concave embodiment may allow a miner to transit the closed door via a revolving door action, by rotating the door to expose the opening thereby allowing the miner to transit to the opposite side of the wing 101 or 102, or the like. The wing 101 or 102 may include top and bottom pivots that are parallel to the top and the bottom of the wing 101 or 102. The pivots may include bearings capable of receiving respective pivot posts of the concave door, located at respective top and bottom portions of the concave personnel access door. The top pivot post of the concave personnel access door may be configured to operatively engage the bearing of the top pivot and the bottom pivot post may be configured to operatively engage the bearing of the bottom pivot. Accordingly, such an embodiment enables the concave personnel access door to rotate about an axis perpendicular to the top and bottom of the wing 101 or 102 in which it is placed.

As shown in FIGS. 5A-5B, the personnel access door 210 is suitably dimensioned to fit within the wing 101 or 102 without hindering operation thereof. The personnel access door 210 is moveably affixed to the wing 101 or 102 via a top rail 216 and a bottom rail 217. Coupled to the personnel access door 210 is a set of trolley wheels 218, located at the top portion of the door 210 and configured to ride on or in the top rail 216. It will be understood that while shown in FIGS. 5A-5B as affixed to the top of the personnel access door 218, the trolley wheels 218 may be rollers, casters or the like on the bottom of the door 210, thereby allowing the door 210 to slide along the bottom rail 217. In addition, embodiments of the personnel access door 210 may include only a top rail 216 on the wing 101-102, a top rail 216 and lower guides, and the like.

When the top slide rail 216 is configured to interact with the trolley wheels 218, the bottom rail 217 functions as a guide to keep the personnel access door 210 flush with the surface of the wing 101 or 102 so as to preserve the air-flow functionality of the ventilation door assembly 100 when closed. Accordingly, the trolley wheels 218 may be on the bottom rail 217 while the top rail 216 functions as a guide rail. Alternatively, several small guides may be used in place of the bottom rail 217.

Depending upon implementation, the personnel access door 210 may be located adjacent to the bottom of the wing 101 or 102, i.e. the sill 104, or slightly elevated, e.g. above the bottom of the wing 101 or 102. One or more sensors (not shown) may be placed in proximity to the personnel access door 210 so as to provide feedback and information as to when the door 210 is opened, closed, the number of miners transiting the door 210, and the like. In one embodiment, the sensors may provide this information to a display associated with the mine door assembly 100, to a control system proximal or remote to the door assembly 100, and the like.

In some embodiments, as depicted in FIGS. 5A-5B, the personnel access door 210 is constructed of suitably sturdy materials. Thus, as illustrated, the door 210 may include a frame having a top 211, bottom 212, first vertical post 213 and second vertical post 214. The frame of the door 210 may further include a plurality of crossbeams 215 of equal dimensions, parallel to the top 211 and bottom 212. The frame components 211-214 and the crossbeams 215 may be constructed of 1½ square steel tubing of 3/16 thickness. Other dimensions and thickness of the frame components 211-214 and the crossbeams 215 may be used, depending upon the application, i.e., the expected air pressure the door assembly 100 is designed to withstand. To maintain the ventilation properties of the door assembly 100, the personnel access door 210 may include a suitable thickness skin 220 over the frame components 211-214 and crossbeams 215. For example, 10-gauge sheeting may provide suitable resilience for low to medium airflow applications, while thicker sheeting may be necessary for higher pressure applications.

According to one embodiment, the personnel access door 210 is dimensioned to extend a predetermined distance around an opening 219 in the wing 101 or 102. Such dimensioning may allow the rails 216 and 217 to be suitably placed above and below the opening 219, preventing airflow in either direction from damaging the door 210, jamming the door 210 so as to stop it opening or closing, and the like. As depicted in FIGS. 5A-5B, the opening may be advantageously sized high enough to allow a miner to walk through erect, wide enough to permit passage of small equipment, e.g., stretchers, tools, piping, emergency supplies, fully equipped emergency personnel, and the like.

It will be appreciated that the dimensions of the personnel access door 210 is dependent upon the size of the mine door assembly 100, e.g., for smaller door assemblies, the personnel access door 210 may be dimensioned such that a miner may be required to crouch or crawl through to make passage. In other embodiments, the width of the personnel access door 210 may be constrained due to the width of the wing 101 or 102 as well as working door pressure, e.g., at very high pressures, the door 210 may be dimensioned accordingly to prevent loss of structural integrity of the door 210 and the wing 101 or 102 to which the door 210 is affixed. In one example embodiment, the personnel access door 210 is 2.5 wide×4 feet high and located approximately 18 inches above the sill 104. Variations on these dimensions and locations may be made in accordance with the embodiments disclosed herein.

In accordance with other embodiments, the top rail 216 and the bottom rail 217 extend at least double the width of the personnel access door 210 so as to allow the door 210 to slide sufficiently to the side to allow full clearance of the opening 219 in the wing 101 or 102. One or more bump-stops may be positioned on the rails 216 and 217 so as to prevent the personnel access door 210 from sliding off the rails 216 and 217 in either direction. A handle may also be affixed to the door 210 to provide a point of contact for personnel. In such an implementation, the handle may be recessed within the skin so as not to interfere with the opening of the door 210 by miners.

Figure 6:
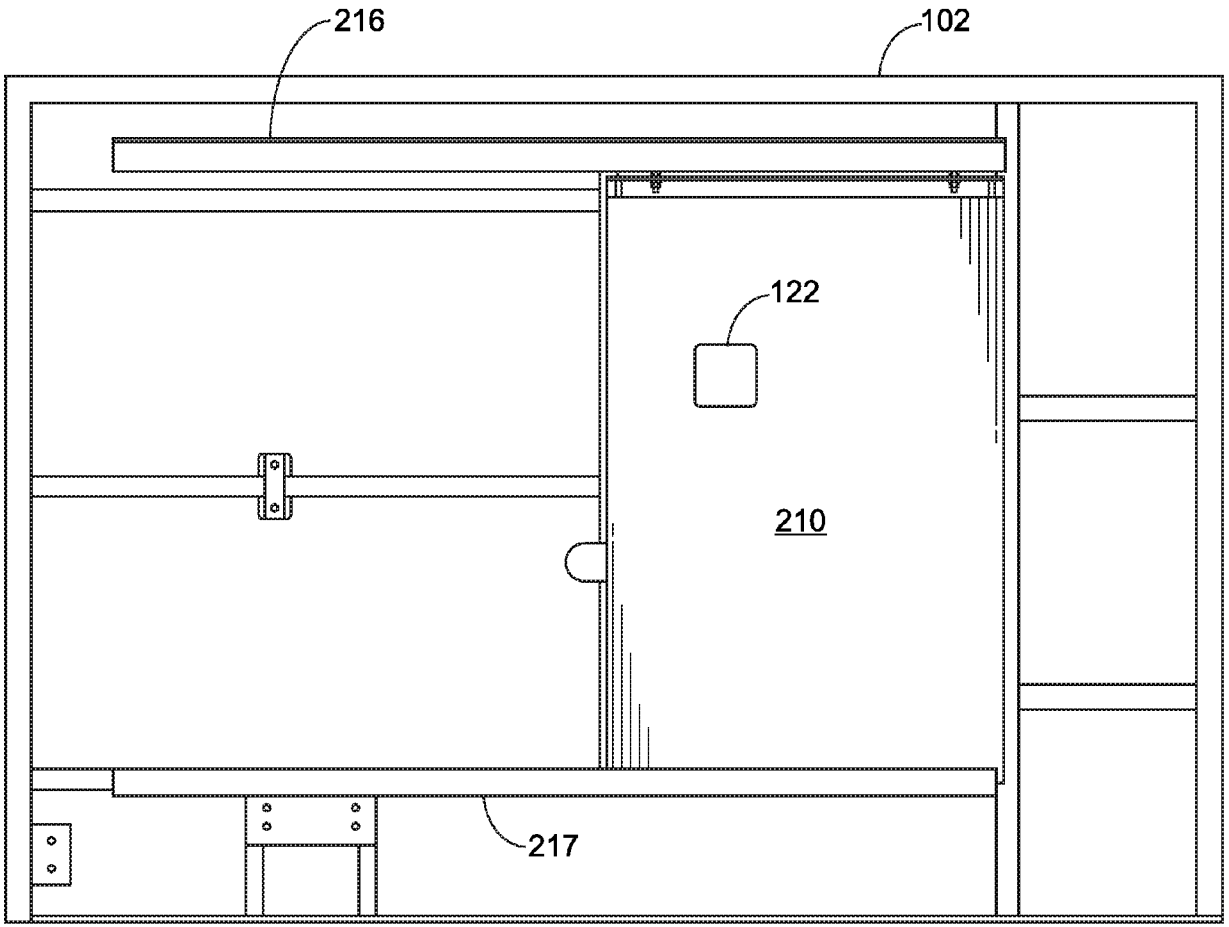
FIG. 6 illustrates one example implementation of the personnel access door in a mine door in accordance with the detailed and isometric representations illustrated in FIGS. 5A-5B.
Figure 7:
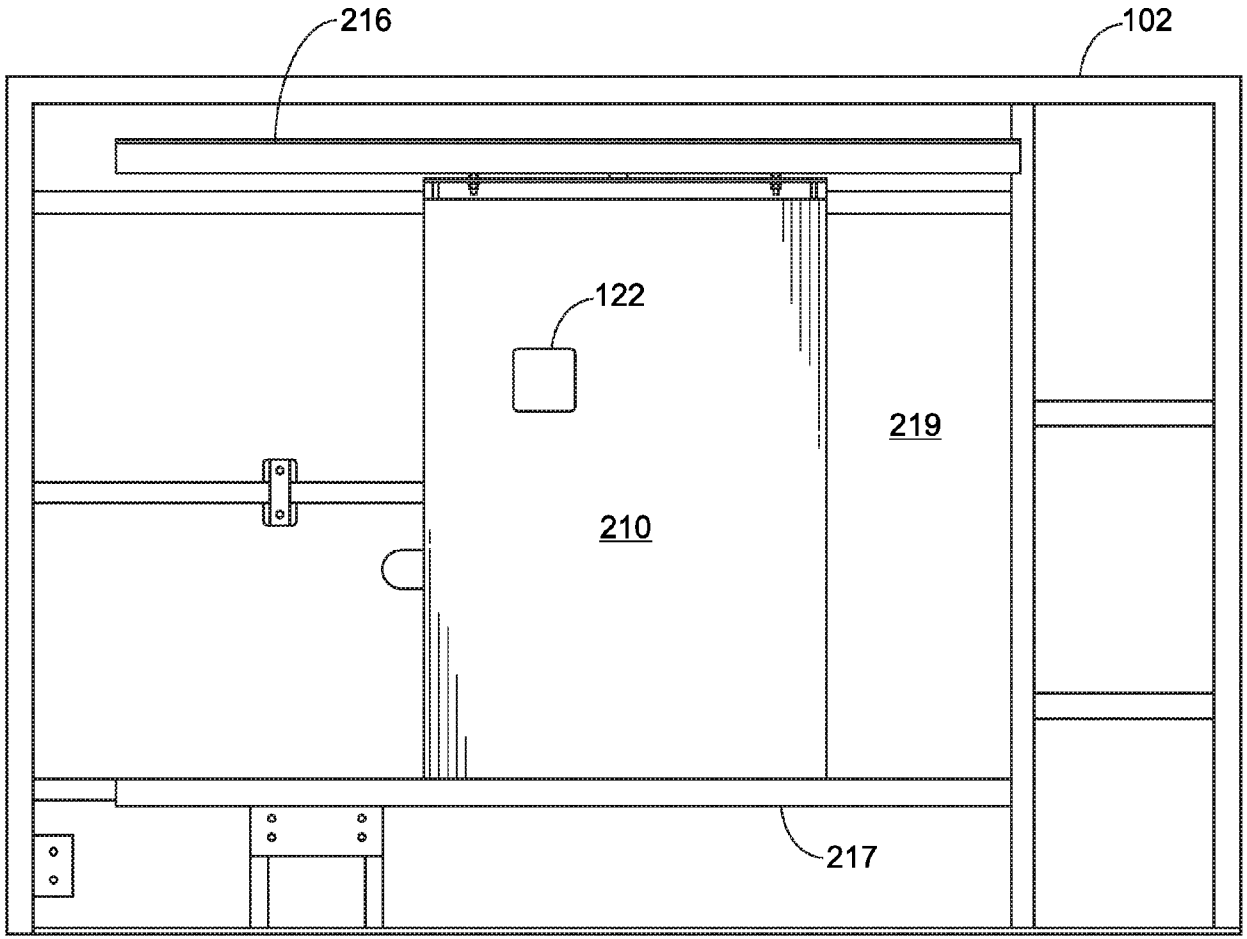
FIG. 7 illustrates the example implementation of the personnel access door partially open in a mine door in accordance with the detailed and isometric representations illustrated in FIGS. 5A-5B.

In still other embodiments, such as the fully closed personnel access door 210 of FIG. 6 and the partially open personnel access door 210 of FIG. 7 may include a window 122 that allows viewing through the mine door assembly 100. In such embodiments, the window is constructed of a suitably force resistant transparent material to withstand the pressures under which the door assembly 100 operates. In other embodiments, for example, the minor wing 102 of FIG. 8, the window may be adjacent to the personnel access door 210 so as to provide viewing to through the mine door assembly 100.

Figure 8:
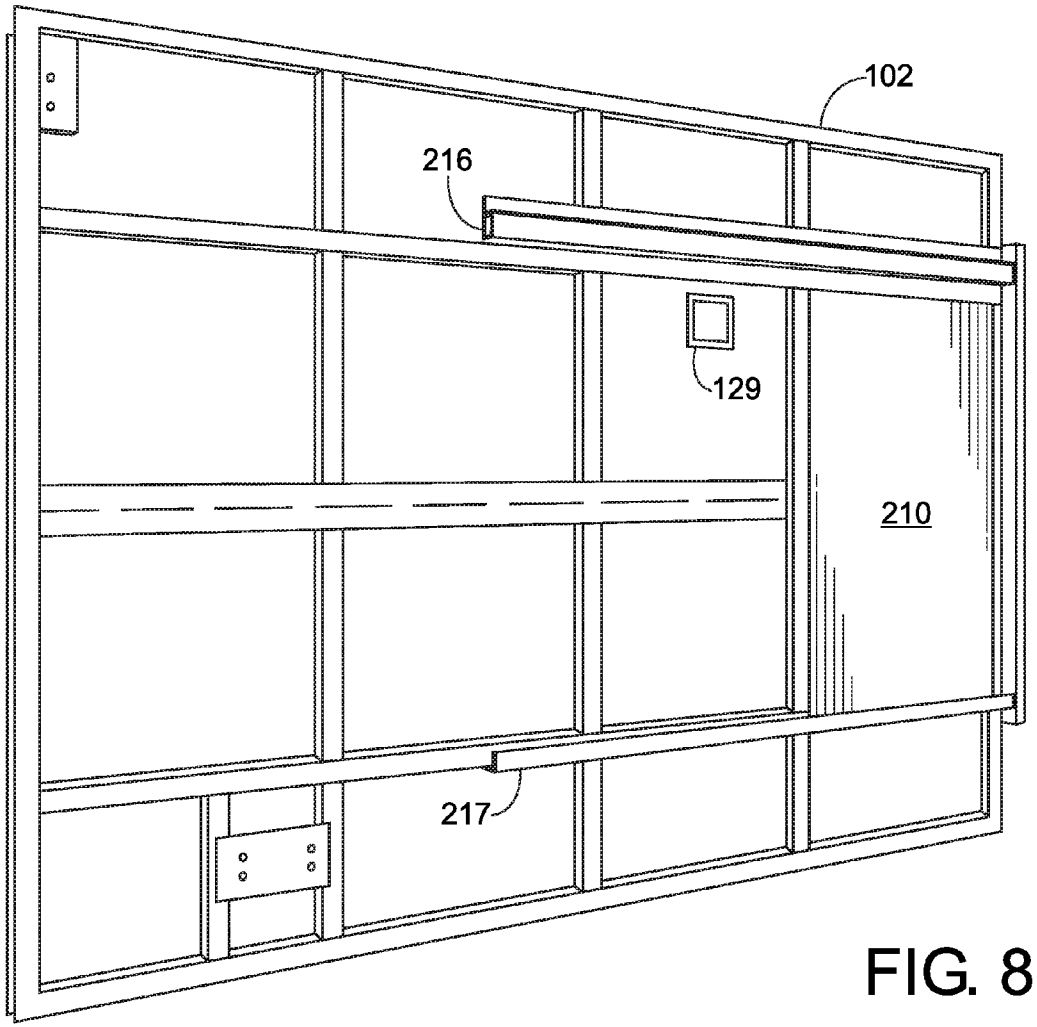
FIG. 8 illustrates another example implementation of the personnel access door lacking a window component in a mine door in accordance with the detailed representation illustrated in FIGS. 5A-5B.

FIGS. 9A-9D depict various views of the wings 101-102 according to one example embodiment of the present disclosure. As illustrated in FIGS. 9A-9D, each wing 101-102 includes a top 124 and a bottom 126 mounting bracket configured to receive the hubs 107-110 discussed above with respect to FIGS. 1A-8. In one embodiment, as shown in FIGS. 9A-9D, a wing 101 and/or 102 may include a window 129 of suitable strength and thickness to withstand high-pressure applications so as to allow viewing through the high-pressure mine door assembly 100. The window 129 may be dimensioned so as to avoid impacting the structural integrity of the wing 101 and/or 102 in which the window 129 is emplaced. A 6 inch×6 inch window 129 is illustrated in FIGS. 8-9A as one example of dimensions capable of being included in accordance with the embodiments disclosed herein. Although illustrated in FIGS. 9A-9D as a single piece, the wing 101 or 102 may be a segmented door structure, allowing for assembly within the mine shaft. In such an implementation, a preselected number of segments (not shown) of the wing 101 or 102 may be bolted, fastened or otherwise affixed to each other and vertical structural components of the wing 101 or 102. It will be appreciated that such an implementation allows faster assembly and ease of shipment of the assembly 100, particularly for large doors or small shaft portions of a mine in which the door assembly 100 is to be emplaced.

According to one embodiment, the personnel access door 210 is a pocket-style door, wherein the rails 216 and 217 are located internal to the wing 101 or 102 to which the door 210 is affixed. In such an embodiment, the door 210 may slide inside the wing 101 or 102 so as to allow transit of miners, equipment, etc., through the ventilation door 100 without requiring the large ventilation door 100 to open.

In some embodiments, the high-pressure door includes at least one sensor operative to detect at least one of a vehicle, minor, control signal, or the like, so as to initiate an opening cycle. In such an embodiment, the door may include one or more sensors configured to detect any obstruction in the path of the wings or in the shaft so as to prevent the wings from closing. In one embodiment, the sensors comprise a pair of sonic sensors, wherein the tripping of a first sensor (in either direction) directs the opening of the door assembly 100, and the tripping of a second sensor (located on an opposing side of the door assembly 100 and facing the opposite direction of the first sensor) directs the closing of the door assembly 100. Other sensors may also be implemented, e.g., a motion sensor operable to detect an object, person, or the like transiting the door assembly 100, as discussed in greater detail herein.

Other embodiments may utilize and automated or remote control system, which uses preprogrammed instructions, receives various sensor inputs, or a combination thereof, to open and close the wings 101-102 of the door assembly 100. For example, pull cords, push buttons, infrared or RF controls, proximity sensors, pressure sensors, manual, etc., may be used in operating the door assembly. In one embodiment, cap lamp sensors are used to facilitate the opening and closing of the door assembly 100, i.e., sensors used to detect the presence of a miner using a transmitter or other device embedded or affixed to a mining helmet, light source, etc.

The assembly 100 may further include a control system that is configured to control the operation of the assembly 100 in accordance with data received from sensors, programs, manual input, and the like. In such an embodiment, the control system may activate the drive mechanism 112 so as to open the wings 101-102 and allow transiting through the assembly 100, or close the wings 101-102 to prevent airflow from transiting the assembly 100. The control system may be proximally located with respect to the assembly 100, or remotely located therefrom, e.g., above-ground. In embodiments wherein the control system is located proximal to the mine door assembly 100, information and/or data related to the operation of the assembly 100 may be communicated to a remote location via Ethernet, wireless, RF, wired, or other communication means. In some other embodiments, the control system may include manual bypasses allowing operation of the doors when power, air supply, or hydraulics fail.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A personnel access door assembly of at least one opposing wing of an associated mine ventilation door, comprising:

a personnel access door including:

a frame including a top portion, a bottom portion, a first post portion and a second post portion, the top frame portion and the bottom frame portion coupled to respective top and bottom ends of the first post and second post portions, and at least one set of trolley wheels affixed to the top portion of the frame;

a top rail affixed to the at least one opposing wing, the top rail parallel to a top and bottom of the at least one opposing wing, the top rail configured to slideably engage the at least one set of trolley wheels; and a bottom rail affixed parallel to the bottom of the at least one opposing wing, the bottom rail and the top rail configured to slideably receive the respective top and bottom portions of the frame.

2. The personnel access door assembly of claim 1, wherein the personnel access door further comprises a set of parallel crossbeams coupled to the first and second posts of the frame, the crossbeams positioned equidistant from each other and the top and bottom frame portions.

3. The personnel access door assembly of claim 2, wherein the personnel access door further comprises a skin covering the frame portions.

4. The personnel access door assembly of claim 3, wherein the skin comprises a suitable gauge metal.

5. The personnel access door assembly of claim 4, wherein the skin includes a window.

6. The personnel access door assembly of claim 2, wherein the bottom rail comprises a plurality of separate guides configured to hold the personnel access door to the wing of the associated mine ventilation door.

7. The personnel access door assembly of claim 2, wherein the personnel access door is located adjacent to a bottom of the wing.

8. The personnel access door assembly of claim 2, further comprising at least one sensor affixed to the wing in proximity to the personnel access door, the sensor configured to sense at least one of an opening and a closing of the personnel access door.

9. The personnel access door assembly of claim 2, wherein the personnel access door further comprises a handle affixed to the personnel access door.

10. The personnel access door assembly of claim 9, wherein the handle is a recessed handle.

11. The personnel access door assembly of claim 2, wherein the frame portions and crossbeams comprise tubular steel.

12. The personnel access door assembly of claim 2, wherein the personnel access door is sized larger than the size of an opening in the associated wing, the opening comprising a path there through.

13. A mine ventilation door including two opposing wings, at least one opposing wing comprising:

an opening extending from a first side of the opposing wing to a second side of the at least one opposing wing;

a top rail parallel to a top and a bottom of the at least one opposing wing;

a bottom rail parallel to the top rail; and a personnel access door, including:

a frame including a top portion, a bottom portion, a first post portion and a second post portion, the top frame portion and the bottom frame portion coupled to respective top and bottom ends of the first post and second post portions, a skin covering the frame portions, and at least one set of rollers affixed to at least one of the top portion and bottom portion of the frame configured to slideably engage at least one of the top and bottom rails.

14. The mine ventilation door of claim 13, wherein the personnel access door further comprises a set of parallel crossbeams coupled to the first and second posts of the frame, the crossbeams positioned equidistant from each other and the top and bottom frame portions.

15. The mine ventilation door of claim 14, wherein the personnel access door further comprises a skin covering the frame portions.

16. The mine ventilation door of claim 14, wherein the top rail and the bottom rail are located within the at least one opposing wing.

17. The mine ventilation door of claim 16, wherein the personnel access door is configured to slide into the at least one opposing wing along the top rail and the bottom rail.

18. The mine ventilation door of claim 14, wherein the top rail and the bottom rail are externally located on the first side or the second side of the at least one opposing wing.

19. The mine ventilation door of claim 18, wherein the personnel access door is configured to slide along the externally located top rail and the bottom rail.

20. The mine ventilation door of claim 14, wherein the rollers are selected from the group consisting of trolley wheels and casters.

21. The mine ventilation door of claim 20, wherein the rollers comprise casters, and wherein the casters are affixed to the bottom portion of the frame so as to slideably engage the bottom rail.

22. The mine ventilation door of claim 20, wherein the rollers comprise trolley wheels, and wherein the trolley wheels are affixed to the top portion of the frame so as to slideably engage the top rail.

* * * * *